US005531927A

United States Patent [19]

Peters

[11] Patent Number: 5,531,927

[45] Date of Patent: Jul. 2, 1996

[54] STAIN REMOVING COMPOSITIONS AND METHODS OF USING THE SAME

[75] Inventor: Donald F. Peters, Lakewood, Ohio

[73] Assignee: Bio-Safe Specialty Products, Inc., Mayfield Hts., Ohio

[21] Appl. No.: 309,799

[22] Filed: Sep. 21, 1994

Related U.S. Application Data

[63] Continuation of Ser. No. 855,224, Mar. 20, 1992, abandoned.

[51] Int. Cl.[6] ..... C11D 7/50; C11D 3/43; C11D 3/44

[52] U.S. Cl. ..... 510/281; 510/280; 510/432; 510/435; 510/505; 510/424

[58] Field of Search ..... 252/162, 153, 252/170, 171, DIG. 8, 19, 8.6, 139, 523, 531, 545, 174.21

[56] References Cited

U.S. PATENT DOCUMENTS

| | | | |
|---|---|---|---|
| 114,464 | 5/1871 | Neill | 252/153 |
| 3,001,947 | 9/1961 | Stahler et al. | 252/153 |
| 3,124,537 | 3/1964 | Milholland | 252/153 |
| 3,463,735 | 8/1969 | Stonebraker et al. | 252/162 |
| 3,625,909 | 12/1971 | Berg | 252/153 |
| 3,679,609 | 7/1972 | Castner | 252/DIG. 19 |
| 3,764,544 | 10/1973 | Haworth | 252/170 |
| 3,839,234 | 10/1974 | Roscoe | 252/153 |
| 3,872,021 | 3/1975 | McKnight | 252/121 |
| 4,336,024 | 6/1982 | Denissenko et al. | 252/DIG. 19 |
| 4,490,270 | 12/1984 | Hackett et al. | 252/106 |
| 4,548,727 | 10/1985 | Shaer | 252/174 |
| 4,689,167 | 8/1987 | Collins et al. | 252/95 |
| 4,698,181 | 10/1987 | Lewis | 252/527 |
| 4,704,233 | 11/1987 | Hartman et al. | 252/527 |
| 4,711,739 | 12/1987 | Kandathil | 252/DIG. 19 |
| 4,738,791 | 4/1988 | Ertle | 252/153 |
| 4,738,792 | 4/1988 | Ertle | 252/153 |
| 4,747,977 | 5/1988 | Whitehead et al. | 252/111 |
| 4,797,231 | 6/1989 | Schumann et al. | 252/547 |
| 4,895,675 | 1/1990 | Smith | 252/539 |
| 4,915,854 | 4/1990 | Mao et al. | 252/8.8 |
| 4,992,212 | 2/1991 | Corring et al. | 252/542 |
| 5,002,684 | 3/1991 | Beck et al. | 252/DIG. 19 |
| 5,013,486 | 5/1991 | Joshi et al. | 252/559 |
| 5,024,780 | 6/1991 | Leys | 252/162 |
| 5,073,274 | 12/1991 | Caswell | 252/8.6 |
| 5,389,278 | 2/1995 | Minns et al. | 252/102 |

OTHER PUBLICATIONS

Derwent Abstract accession No. 90–173735, for HU 51323, Apr. 30, 1990.

*Primary Examiner*—Paul Lieberman
*Assistant Examiner*—Ardith Hertzog
*Attorney, Agent, or Firm*—Renner, Otto, Boisselle & Sklar

[57] ABSTRACT

This invention relates to a stain removing composition comprising (A) from about 5 to about 80 percent by weight of a polyol having from 2 to about 6 carbon atoms and 2 to about 6 hydroxyl groups, (b) from about 0.1 to about 10 percent by weight ammonia, (C) from 1 to about 20 percent by weight of an ester, and (D) water. The compositions may additionally contain (E) a cleaner or surfactant. The invention also includes methods of removing stains from textiles. The stain removing compositions are effective in removing food dyes while not reacting with aniline (textile) dyes. The stain remover works on delicate fabrics, including silks. The stain removing compositions are environmentally safe and are free of chlorinated and petroleum distillate solvents.

22 Claims, No Drawings

STAIN REMOVING COMPOSITIONS AND METHODS OF USING THE SAME

This is a continuation of application Ser. No. 07/855,224 filed on Mar. 20, 1992, now abandoned.

TECHNICAL FIELD OF THE INVENTION

This invention relates to compositions useful in removing stains from fabrics and upholstery and methods of using the same.

BACKGROUND OF THE INVENTION

Many stains on textiles such as fabrics, carpeting and upholstery are difficult to remove. The stains may be caused by food dyes, wine, inks, grape juice, cranberry juice, blood, spaghetti sauce, chocolate syrup, coffee, some teas, cosmetics, fruit juices, grass and others. A particularly difficult stain for removing from textiles is the stain caused by FD & C red dye 40. This dye produces the red color in Kool-Aid.

Therefore, it is desirable to have a stain remover which would effectively remove stains from textiles. More particularly, it would be beneficial to have a stain remover which would remove food dyes, including FD & C red dye 40. It would be beneficial to have a composition to remove these dyes even from delicate fabrics such as silks.

SUMMARY OF THE INVENTION

This invention relates to a stain removing composition comprising (A) from about 5 to about 80 percent by weight of a polyol having from 2 to about 6 carbon atoms and 2 to about 6 hydroxyl groups, (B) from about 0.1 to about 10 percent by weight ammonia, (C) from 1 to about 20 percent by weight of an ester, and (D) water. The compositions may additionally contain (E) a detergent or surfactant. The invention also includes methods of removing stains from textiles. The stain removing compositions are effective in removing food dyes while not reacting with aniline (textile) dyes. The stain remover works on delicate fabrics, including silks. The stain removing compositions are environmentally safe and are free of chlorinated and petroleum distillate solvents.

DETAILED DESCRIPTION OF THE INVENTION

As used herein the term detergent or surfactant refers to single chemicals as well as combinations of chemicals which facilitate removal of the stain from the fabric.

As described above, the stain removing compositions of the present invention contain a polyol. The polyol generally contains from 2, or 3 up to about 6, or to about 4 carbon atoms, preferably 3 carbon atoms. The polyol generally contains about 2, or about 3 up to about 6, or to about 4 hydroxyl groups, preferably 3 hydroxyl groups. Examples of useful polyols include ethyleneglycol, propyleneglycol, 1,2-propanediol, 1,3-propanediol, 1,2-butanediol, 1,3-butanediol, 1,4-butanediol, 1,2,4-butanetriol, 1,2-pentanediol, 1,4-pentanediol, 1,5-pentanediol, 2,4-pentanediol, 1,2-hexanediol, 1,5-hexanediol, 1,6-hexanediol, 1,2,6-hexanetriol, trimethylol-propane and glycerol. In one embodiment, the polyol is ethylene glycol, propyleneglycol, 1,3-propane diol, or glycerol, preferably glycerol.

The polyol is generally present in an amount from about 5 percent, or about 15 percent, or about 25 percent, or about 30 percent up to about 80 percent, or to about 70 percent, or to about 60 percent, or to about 50 by weight of stain removing composition. In one embodiment, the polyol is present in amount from about 35 percent, or about 40 percent up to about 50 percent, or to about 47 percent by weight of stain removing composition.

The stain removing compositions of the present invention additionally contain an ester. The ester used is a carboxylic ester having from 1 to about 21, or to about 12, or to about 8 or to about 6, or about 4 carbon atoms in the carboxy portion of the ester. The alkoxy portion of the ester has from 1, or about 2, or about 3 up to about 30, or to about 24, or to about 12, or to about 8 carbon atoms. In one embodiment, the carboxy portion of the ester has from 1 to about 4 carbon atoms, and the alkoxy portion of the ester has from 3 to about 8, or about 4 carbon atoms. Examples of carboxylic esters include propyl, butyl, amyl or hexylacetate; propyl, butyl, amyl, or hexylpropanoate; and the like. A particularly useful carboxylic ester is amyl acetate.

In one embodiment, the carboxylic ester is represented by the formula $$R_1C(=O)-OR_2$$

wherein $R_1$ contains from 1 to about 21, or about 12, or about 8, or about 6, or about 4 carbon atoms, and $R_2$ contains from about 1, or about 2, or about 3 up to about 30, or to about 24, or to about 12, or to about 8 carbon atoms. In one embodiment, $R_1$ is a methyl, ethyl or propyl group, preferably a methyl group. In one embodiment, $R_2$ is a propyl, butyl, amyl, pentyl, hexyl, octyl, decyl, dodecyl or a hexadecyl group, preferably a propyl, butyl, amyl or hexyl group, more preferably an amyl group.

The ester is present in an amount from about 1%, or about 5%, or about 8% up to about 20%, or to about 17%, or to about 15%, or to about 12% by weight of the stain removing composition. In one embodiment, the ester is present in an amount from about 8%, or about 9% up to about 12%, or to about 11% by weight of the stain removing composition.

The water present in the stain removing compositions is generally the balance of the composition, e.g., the amount required to make one hundred percent of the composition. Typically, the water is present in an amount from about 20%, or about 30% up to about 60%, or to about :50% of the stain removing composition.

In one embodiment, the stain removing composition additionally contains (E) a detergent or surfactant.

In one embodiment, (E) is a nonionic surfactant. In one embodiment, the nonionic surfactant is a polyoxyalkylene surfactant, preferably a polyoxyethylene or polyoxypropylene surfactant. The nonionic surfactant may be a polyalkoxylated phenol, alcohol, amine or amide.

The polyalkoxylated phenol is generally prepared by treating a phenol, preferably an alkylphenol, with an epoxide. The phenols include phenol and alkylphenol, wherein the alkyl group contains from 1, or about 4, or about 6 up to about 30, or to about 24, or to about 18, or to about 12 carbon atoms. Preferably, the phenol is an octylphenol or a nonylphenol. The polyalkoxylated phenol, also referred to as a polyoxyalkylated phenol, contains alkyleneoxy groups. The alkyleneoxy groups are derived from epoxides which generally contain from 2 up to about 8, or to about 6, or to about 4 carbon atoms. Examples of these epoxides include ethyleneoxide, propyleneoxide, butyleneoxide, cyclohexeneoxide, styreneoxide and the like. The polyalkoxylated phenols are preferably polyethoxylated phenols or polypropoxylated phenols. The polyalkoxylated phenols generally contain an average of about 3, or about 5 up to about 30, or to about 25, or to about 15 moles of alkyleneoxy groups per mole of polyalkoxylated phenol. The polyalkoxylated phenols are prepared by means known to those in the art. Examples of commercially available polyalkoxylated phenols include Igepal surfactants available from GAF Chemicals, Incorporation. These materials are ethoxylated octylphenol and ethoxylated nonylphenol. An example of a preferred polyalkoxylated phenol includes Igepal CO-620.

The polyalkoxylated alcohol is generally prepared by treating an alcohol, preferably a linear alcohol, with an epoxide. The alcohol generally contains from 1, or about 2 up to about 30, or to about 24, or to about 12 carbon atoms. Examples of alcohols which may be treated with epoxides include methyl alcohol, propyl alcohol, octyl alcohol, etc. The polyalkoxylated alcohol contains alkyleneoxy groups. The number of alkyleneoxy groups is the same as described for the alkoxylated phenols derived from epoxides. The epoxides have been described above. The polyalkoxylated alcohols are preferably polyethoxylated alcohols or polypropoxylated alcohols, preferably polyethoxylated alcohols.

The nonionic surfactant may also be an alkoxylated glycol. These materials are made by reacting a glycol with an epoxide. The epoxides have been described above. Glycols include ethylene glycol, propylene glycol, butylene glycol, etc. These materials are prepared by means known to those in the art. The number of alkyleneoxy groups is the same as described for the alkoxylated phenol.

The nonionic surfactant may also be a polyalkoxylated diamine. The diamine is treated with an epoxide to form these materials. Preferred surfactants prepared by treating ethylenediamine with ethyleneoxide or propyleneoxide.

In another embodiment, the detergent or surfactant (E) is a sulfate detergent. Sulfate detergents include alkyl sulfates, alkylether sulfates, phenol sulfates, phenol ether sulfates, as well as alkyl polyoxyalkylene sulfates, and phenolpolyoxyalkylene sulfates. The sulfates may be amine or metal sulfates. Amine sulfates include ammonium and triethanolamine sulfates. The metal sulfates include alkali metal and alkaline earth metal sulfates, such as sodium, potassium and magnesium sulfates.

In one embodiment, the sulfate detergent is an alkyl sulfate wherein the alkyl group contains from about 6, or about 8, or about 10 up to about 30, or to about 24, or to about 20 carbon atoms. Examples of useful alkyl sulfates include lauryl sulfate, cetyl sulfate, octyl sulfate, and tridecyl sulfate. A preferred alkyl sulfate is sodium lauryl sulfate.

The sulfate detergent may also be an alkyl polyoxyalkylene sulfate wherein the alkyl group contains from about 6, or about 8 up to about 30, or to about 24, or to about 18 carbon atoms. The alkyl polyoxyalkylene sulfate generally contains from 1, or about 2 up to about 25, or to about 15, or to about 5 alkyleneoxy groups. The alkyl polyalkylene sulfate may be prepared by reacting an alcohol with an epoxide to form an alkyl polyalkylene alcohol. The alcohol may then be sulfated as is known to those in the art. Alkyl groups of the alky polyoxyalkylene sulfate include octyl, decyl, dodecyl, hexadecyl, and octadecyl alkyl groups. Alkyl groups may be derived from the alcohols described above for the polyalkoxylated alcohols.

The sulfate detergent may also be an alkylphenol polyoxyalkylene sulfate. The alkyl group generally contains from 6, or about 8 up to about 18, or to about 12, or to about 10 carbon atoms. The alkylphenol polyoxyalykylene sulfates generally contain from about 1, or about 2 up to about 25, or to about 15, or to about 6 alkyleneoxy groups. The alkylphenol polyoxyalkylene sulfates are prepared by reacting an alkylphenol with an epoxide. The reaction product is then sulfated as to those known in the art. The alkylphenols, the epoxides and the reaction products are described above.

In a preferred embodiment, the sulfate detergent in an amido-ether sulfate. The amido-ether sulfate generally is prepared by reacting an amide with an epoxide to form a polyalkoxylated amide. This amide is then sulfated as is known to those in the art. The amides are generally fatty amides containing from 8, or about 10 up to about 30, or to about 24, or to about 18 carbon atoms. The amido-ether sulfates generally contain from 1, or about 2 up to about 15, or about 10, or about 6 alkyleneoxy groups. An example of amido-ether sulfate include lauroylamide polyethoxy sulfate, and caprylamide polypropoxy sulfate. An example of a commercially available amido-ether sulfate is Monamine 779 available from Mona Industries, Inc. In another embodiment, the detergent or surfactant (E) is a phosphate builder. Phosphate builders include sodium and potassium tripolyphosphate, pyrophosphate, polymeric metaphosphates having a degree of polymerization of from 6 to 21 and orthophosphate. Preferred phosphate builders are alkali metal tripolyphosphates, preferably sodium tripolyphosphate.

In one embodiment, the nonionic surfactant is used together with the amido-ether sulfate. In another embodiment, the sodium tripolyphosphate is used together with the sodium lauryl sulfate.

The methods of the present invention involve applying the stain removing compositions of the present invention to a stained textile, such as a fabric, carpeting or upholstery. The textile is agitated to ensure contact of the stain removing composition with the stain. Agitation may be accomplished by lightly rubbing the fabric with a finger or a brush. The stain may then be removed by ordinary laundering, such as an household detergent. In another embodiment the stain is removed by applying an extracting cloth to the stained textile. The extracting cloth is typically a hundred percent cotton cloth, such as a towel or cloth sufficient to extract stain from the textile. In one embodiment, the extracting cloth forms a sandwich around the stained textile.

To facilitate removal of the stain, the textile and extracting cloth may be heated, such as with an iron or steam. When using a typically household iron, the iron should be set for maximum heat.

A typical procedure for removing stains by the heat transfer procedure would be applying formula directly to the stained textile. Rubbing the stain removing composition into the stained textile with a brush. A wet cotton towel is placed over the stained area of the textile and an iron, which has previously been set on the highest setting, is applied to the towel over the stain. The towel is checked every fifteen seconds to see if stain is being transferred to the towel. The iron is applied until the stain is removed. As stain is removed into the towel, a clean portion of towel is placed over the stained textile. If the stain is not appearing in the towel, more stain removing composition should be applied to the textile. After removal of the stain, the textile may be cleaned by ordinary laundering procedure.

The following example to relate to stain removing compositions of the present invention. Unless otherwise indicated in the specification and claims, parts and percentages are by weight, pressure is atmospheric and temperature is in degrees Celsius.

EXAMPLE A

A stain removing composition is prepared by mixing 1.28 parts of ammonia with 44.4 parts of water, 43 parts of glycerin and 10 parts of amyl acetate. The mixture is stirred until the ingredients are mixed. Stirring lasts about sixty seconds.

EXAMPLE B

A stain removing composition is prepared as described in Example A except the composition additionally contains one part of Monoamine 779, an amido-ether sulfate available commercially from Mona Industries.

EXAMPLE C

A stain removing composition is prepared as described in Example A except the composition additionally contains one part of Igepal CO-620, an ethoxylated nonylphenol available commercially from GAF Chemicals Corporation.

EXAMPLE D

A stain removing composition is prepared as described in Example A except the composition additionally contains one part sodium tripolyphosphate.

The stain removing compositions of the present invention are tested on textiles including 65%/35% polyester/cotton blends, cotton, silk, upholstery fabric, and non-stain resistant carpet. The textiles are stained with grape juice, cranberry juice, red wine and Kool Aid (containing FD & C red dye 40). The test fabrics or the test textiles are saturated with the staining liquids and then are aged for either one to seven days. The area stained is 2.2 inches and that area is saturated with the staining material. The fabrics are treated with the stain removing composition of Example G. The upholstery and carpeting materials are scrubbed lightly with a brush. The wetted stains are sandwiched between two pieces of wet cotton terry cloth and a clothes iron set on maximum setting is applied to the sandwich for ten seconds. The textile was then laundered by ordinary procedures, i.e. hand or machine laundering.

The following Table contains the description of the stain removal results of various fabrics of the stain removing composition of Example G.

STAIN REMOVAL RESULTS

| | SUBSTRATE | | | | | | | | | | |
|---|---|---|---|---|---|---|---|---|---|---|---|
| Stain | 65% Polyester 35% Cotton | 100% Cotton | Rayon | Silk | 50% Cotton 50% Polyester | 80% Polyester 20% Combed Cotton | Olefin Carpet | 100% Nylon Carpet | 100% Nylon Stainblocker Carpet | Polyester Carpet | Wool Carpet |
| Cherry Kool-Aid Red Dye #40 | 100% | 100% | 100% | 100% | 100% | 100% | 100% | 100% | 100% | 100% | 100% |
| Grape Juice | 100% | 100% | 100% | 100% | 100% | 100% | 100% | 100% | 100% | 100% | 100% |
| Makeup Oil Iron Base | 80% | 80% | 80% | 80% | 80% | 80% | 80% | 80% | 80% | 80% | 80% |
| Blood | 100% | 100% | 100% | 100% | 100% | 100% | 100% | 100% | 100% | 100% | 100% |
| Chocolate Syrup | 100% | 100% | 100% | 100% | 100% | 100% | 100% | 100% | 100% | 100% | 100% |
| Grass | 100% | 100% | 100% | 100% | 100% | 100% | 100% | 100% | 100% | 100% | 100% |
| Tea Orange Black Pekoe | 90% | 90% | 90% | 90% | 90% | 90% | 90% | 90% | 90% | 90% | 90% |
| Red Wine | 100% | 100% | 100% | 100% | 100% | 100% | 100% | 100% | 100% | 100% | 100% |
| Cranberry Juice | 100% | 100% | 100% | 100% | 100% | 100% | 100% | 100% | 100% | 100% | 100% |
| Spaghetti Sauce | 90% | 90% | 90% | 90% | 90% | 90% | 90% | 90% | 90% | 90% | 90% |
| Coffee | 100% | 100% | 100% | 100% | 100% | 100% | 100% | 100% | 100% | 100% | 100% |
| Used Motor Oil | 100% | 100% | 100% | 100% | 100% | 100% | 100% | 100% | 100% | 100% | 100% |
| Black Ink Ballpoint | 60% | 60% | 60% | 60% | 60% | 60% | 60% | 60% | 60% | 60% | 60% |

EXAMPLE E

A stain removing composition is prepared as described in Example A except the composition additionally contains one part sodium lauryl sulfate.

EXAMPLE F

A stain removing composition is prepared by mixing 1.28 parts of ammonia, 43.77 parts of water, 43.04 parts of glycerin, 0.82 parts of sodium tripolyphosphate, 0.82 parts of sodium lauryl sulfate, 10.26 parts of amyl acetate.

EXAMPLE G

A stain removing composition is prepared by mixing 1.28 parts of ammonia, 36.63 parts of water, 43.04 parts of glycerol, 10.26 parts of amyl acetate, 1.83 parts of Igepal CO-620 and 6.96 parts of Monamine 779.

As can be seen from the above table, the stain removing composition of the present invention removed all stains from the 65%/35% polyester/cotton blend, upholstery fabric in non-stain resisting carpeting. The stain removing compositions successfully removed kool-aid stain from silk (Kool-Aid contained FD & C red dye 40). No evidence of color loss is noted in the colored fabrics.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A fabric stain removing composition comprising (A) from 25 to about 80 percent by weight of a polyol having from 2 to about 6 carbon atoms and 2 to about 6 hydroxyl groups, (B) from about 0.1 to about 10 percent by weight ammonia, (C) from 8 to about 20 percent by weight of an ester represented by the formula $$R_1-\overset{\overset{\displaystyle O}{\|}}{C}-OR_2$$

wherein $R_1$ is an alkyl group containing from 1 to about 21 carbon atoms and $R_2$ is an alkyl group containing from 1 to about 30 carbon atoms, and (D) water, wherein the composition is free of chlorinated and petroleum distillate solvents.

2. The composition of claim 1 wherein the polyol has from 2 to about 4 carbon atoms and 2 to about 4 hydroxyl groups.

3. The composition of claim 1 wherein (A) is selected from the group consisting of propylene glycol, ethylene glycol, glycerol and 1,3-propane diol.

4. The composition of claim 1 wherein (A) is glycerol.

5. The composition of claim 1 wherein $R_1$ contains from 1 to about 6 carbon atoms and $R_2$ contains from 1 to about 12 carbon atoms.

6. The composition of claim 1 wherein the ester is amyl acetate.

7. The composition of claim 1 further comprising (E) a surfactant and/or a builder in a sufficient amount to facilitate fabric stain removal.

8. The composition of claim 7 wherein (E) is a nonionic surfactant.

9. The composition of claim 7 wherein (E) is a sulfate or phosphate.

10. The composition of claim 7 wherein (E) is a combination of a nonionic surfactant and an amido-ether sulfate.

11. The composition of claim 7 wherein (E) is a combination of a phosphate and a sulfate.

12. The composition of claim 11 wherein the sulfate is sodium lauryl sulfate and the phosphate is sodium tripolyphosphate.

13. The composition of claim 1 wherein (A) is glycerol, and (C) is amyl acetate.

14. A fabric stain removing composition comprising (A) from 25 to about 80 percent by weight of a polyol having from 2 to about 6 carbon atoms and 2 to about 6 hydroxyl groups, (B) from 0.1 to about 10 percent by weight of ammonia, (C) from 8 to about 20 percent by weight of an ester represented by the formula $$R_1-\overset{\overset{\displaystyle O}{\|}}{C}-OR_2$$

wherein $R_1$ is an alkyl group containing from 1 to about 21 carbon atoms and $R_2$ is an alkyl group containing from 1 to about 30 carbon atoms, (D) water and (E) a combination of a sulfate and a builder in a sufficient amount to facilitate stain removal, wherein the composition is free of chlorinated and petroleum distillate solvents.

15. The composition of claim 14 wherein (A) is selected from the group consisting of propylene glycol, ethylene glycol, glycerol, and 1,3-propane diol.

16. The composition of claim 14 wherein (A) is glycerol and (C) is amyl acetate.

17. The composition of claim 14 wherein (E) is a combination of sodium tripolyphosphate and sodium lauryl sulfate.

18. A stain removing composition comprising (A) from 25 to about 80 percent by weight of a polyol having from 2 to about 6 carbon atoms and 2 to about 6 hydroxyl groups, (B) from 0.1 to about 10 percent by weight of ammonia, (C) from about 8 to about 20 percent by weight of an ester represented by the formula $$R_1-\overset{\overset{\displaystyle O}{\|}}{C}-OR_2$$

wherein $R_1$ is an alkyl group containing from 1 to about 21 carbon atoms and $R_2$ is an alkyl group containing from 1 to about 30 carbon atoms, (D) water and (E) up to about 8.8 percent by weight of a combination of nonionic surfactant and an amido-ether sulfate.

19. The composition of claim 18 wherein (A) is selected from the group consisting of propylene glycol, ethylene glycol, glycerol, and 1,3-propane diol.

20. The composition of claim 18 wherein (A) is glycerol and (C) is amyl acetate.

21. The composition of claim 18 wherein (E) is a combination of a alkoxylated alcohol or phenol and an amido-ether sulfate.

22. A stain removing composition consisting essentially of (A) from 25 to about 80 percent by weight of a polyol having from 2 to about 6 carbon atoms and 2 to about 6 hydroxyl groups, (B) from about 0.1 to about 10 percent by weight ammonia, (C) from 8 to about 20 percent of an ester represented by the formula $$R_1-\overset{\overset{\displaystyle O}{\|}}{C}-OR_2$$

wherein $R_1$ is an alkyl group containing from 1 to about 21 carbon atoms and $R_2$ is an alkyl group containing from 1 to about 30 carbon atoms, and (D) water.

* * * * *